United States Patent [19]

Balbastro

[11] 4,260,154

[45] Apr. 7, 1981

[54] METHOD OF PLAYING A BALL GAME

[76] Inventor: Jose D. Balbastro, 628 E. Chanslorway, Blythe, Calif. 92225

[21] Appl. No.: 14,882

[22] Filed: Feb. 26, 1979

[51] Int. Cl.[3] ..... A63B 67/00

[52] U.S. Cl. ..... 273/411; 273/1.5 R

[58] Field of Search ..... 273/95 H, 85 C, 85 D, 273/85 E, 85 F, 1.5 R, 105 R, 411; 272/3

[56] References Cited

U.S. PATENT DOCUMENTS

| | | | |
|---|---|---|---|
| 2,986,395 | 5/1961 | Sheftel | 273/1.5 R |
| 4,068,846 | 1/1978 | Forrest | 273/105 R |

FOREIGN PATENT DOCUMENTS

| | | | |
|---|---|---|---|
| 356217 | 1/1922 | Fed. Rep. of Germany | 273/105 R |
| 220970 | 9/1924 | United Kingdom | 273/105 R |

*Primary Examiner*—Richard C. Pinkham

*Assistant Examiner*—T. Brown

*Attorney, Agent, or Firm*—Cahill, Sutton & Thomas

[57] ABSTRACT

A game is disclosed in which an inflatable ball is pushed along a playing surface past defensive players of a first team to a goal shooting area by offensive players of a second team. The players move the ball only by pushing the ball with the sides of their feet until they succeed in moving the ball into the goal shooting area. A goal including a circular ring having a diameter substantially greater than the diameter of the ball is mounted on a backboard and is positioned a predetermined height above the playing surface over an outside boundary of the goal shooting area. A designated offensive player of the second team assigned to the goal shooting area then shoots the ball by quickly lifting it with one or both feet, thereby attempting to propel it through the goal to score a field goal.

6 Claims, 7 Drawing Figures

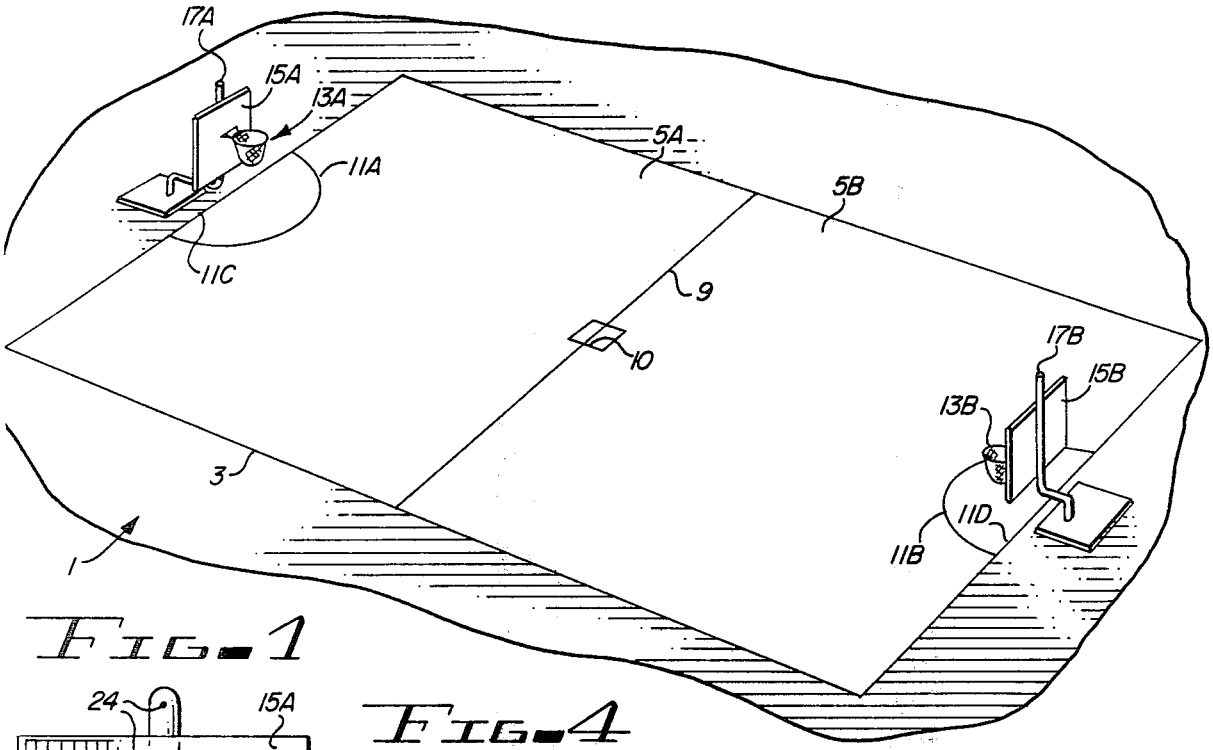
FIG. 1
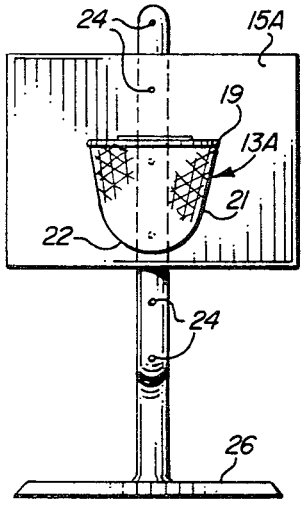
FIG. 2
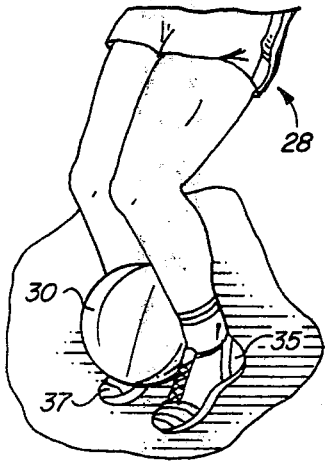
FIG. 4
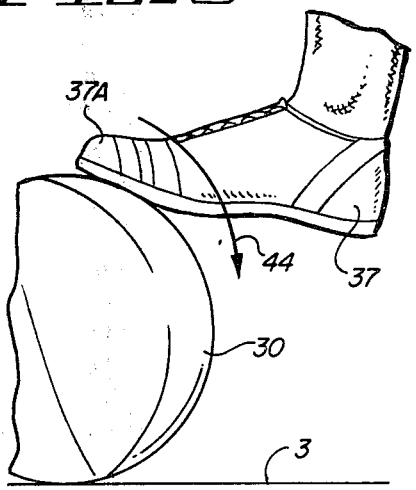
FIG. 5
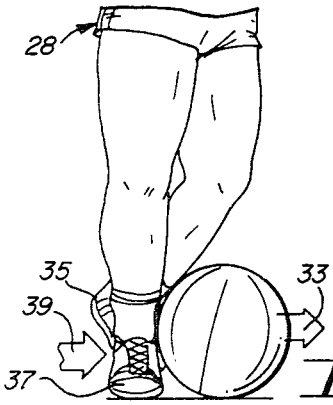
FIG. 3
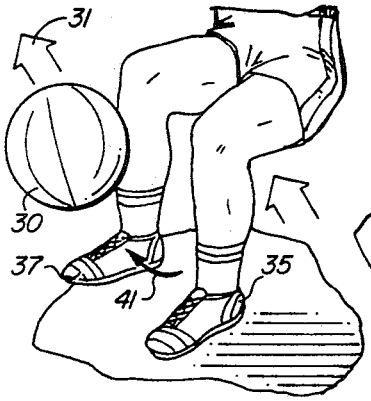
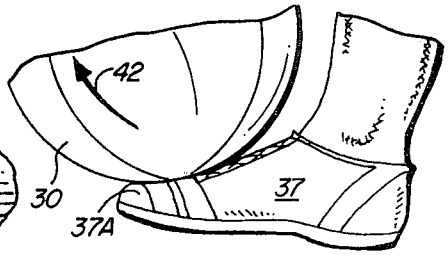
FIG. 7

METHOD OF PLAYING A BALL GAME

BACKGROUND OF THE INVENTION

1. Field of the Invention

The invention relates to ball games in which a ball is moved along a playing surface by players using only the sides of their feet to push the ball and wherein the ball is propelled through a goal supported above the playing surface by an offensive player who uses his feet to quickly lift the ball to accomplish the propelling.

2. Description of the Prior Art

Numerous playground ball games are commonly played by children of elementary school age at schools and elsewhere. Soccer, kick ball, touch football, flag football, tackle football, baseball and basketball are commonly played by children in most areas of the United States. Such games all have the advantages of providing vigorous exercise, development of a sense of competition, development of teamwork skills, and development of strength and endurance in the children who participate in playing the games. However, all of the above games inevitably involve frequent bodily contact between players, running at high speeds, and balls and/or bats moving at high velocities. Consequently, children who are exceptionally large, strong, skillful, and/or aggressive are the ones who frequently excell and obtain most of the benefit of playing such games. The rules of the above games inherently result in the greatest degree of participation and therefore the greatest development of the above skills, strengths, and consequent feelings of self-fulfillment, achievement, etc. in those exceptional children.

However, children of less than average size, strength, speed, skill, and/or aggressiveness benefit less, and may, in some cases, needlessly develop feelings of discouragement and inferiority because of the fact that the rules of the prior games encourage domination of the games by such exceptional or above-average children.

It is therefore a primary object of the invention to provide a ball game which enhances the ability of all participants, including children of less than average size, speed, strength, and/or aggressiveness to develop their coordination, teamwork skills, strength and endurance.

Another object of the invention is to provide such a game which is easy to play and which does not require expensive equipment.

In prior ball games, high running speeds, high ball velocities, and rules which fail to prevent a high degree of bodily contact between players frequently result in minor and sometimes serious injuries to participants. The smaller, less coordinated, and less skillful players are often the ones most likely to be seriously injured.

Still another object of the invention is to provide a ball game which develops strength, endurance, teamwork skills, and sense to competitive success in all of the participants, and which reduces the likelihood of serious injury to all of the players.

Yet another object of the invention is to provide a game which encourages sufficient participation by all players to ensure that all players receive substantial opportunity to move the ball and score points.

SUMMARY OF THE INVENTION

Briefly described, and in accordance with one embodiment thereof, the invention provides a ball game and method of playing wherein players of a first team move a ball along a flat playing surface past a plurality of defending players of a second team toward a goal shooting area by pushing the ball with the sides of their feet. A designated shooter from the first team attempts to shoot the ball from within the goal shooting area through a goal having a loop positioned above the playing surface by quickly lifting the ball with his feet and propelling it upward toward the goal. If the ball passes through the loop, the designated shooter scores a field goal for his team.

In the described embodiment of the invention, the playing surface is substantially rectangular, and is divided into first and second sides, each having a semicircular goal shooting area located at the respective opposite ends of the playing surface. A goal is positioned over the outer edge of each of the goal shooting areas. Each goal is supported by a backboard. The players of the team having control of the ball are referred to as offensive players, and the players of the other team are referred to as defensive players. Each team has a designated shooter who remains in his team's goal shooting area while his teammates try to control or "steal" the ball. The players of each team take turns being their team's designated shooter for a fixed time of ten minutes. As the offensive players move the ball with their feet, the defensive players try to obtain control of the ball by attempting to push it away from the offensive player with the sides of their feet without committing a foul. A foul is committed by kicking or touching the ball with the toe of a foot by either an offensive or defensive player, kicking another player or pushing another player, or by intentionally touching the ball with any other part of the body than the sides of the feet. If the defensive players obtain control of the ball, their team gains possession of the ball, and the offensive and defensive roles of the players are reversed. Once the offensive players succeed in moving the ball into the goal shooting area assigned to their team, the present designated shooter of that team is allowed ten seconds each to attempt to shoot and score two field goals. If the designated shooter fails to score on both field goal attempts, the ball is returned to the center court by the referee, and the other team obtains possession of the ball. The offensive players repeat the foregoing procedure.

If a defensive player succeeds in "stealing" or obtaining control of the ball, his team gets possession of the ball, and try to move the ball to their designated shooter in their goal shooting area. In the described embodiment of the invention, the ball is an inflatable ball approximately the size of a standard basketball. The height of the goal and backboard is adjustable to accommodate the needs and skills of children of different age groups.

BRIEF DESCRIPTION OF THE DRAWINGS

FIG. 1 is a perspective view of a playing court for the game of the invention.

FIG. 2 is a front view of the loop, net, and adjustable support shown in FIG. 1.

FIG. 3 is a diagram useful in explaining how the side of the foot of the player is used in pushing the ball.

FIG. 4 is a diagram useful in describing a first technique for shooting the ball.

FIG. 5 is another diagram useful in explaining the first technique of shooting the ball.

FIG. 6 is a diagram useful in describing a second technique for shooting the ball.

FIG. 7 is another diagram useful in describing the second technique for shooting the ball.

DESCRIPTION OF THE INVENTION

Referring now to FIG. 1, the ball game of the present invention is played on a court 1 having a boundaried rectangular playing surface 3. Playing surface 3 is divided into two half-courts, 5A and 5B by center line 9. A semicircular goal shooting area 11A is centrally positioned at the left end of half-court 5A of the playing surface. A backboard 15A has a goal 13A attached thereto and is supported symmetrically over goal shooting area 11A along boundary 11C on post 17A. Similarly, a semicircular goal shooting area 11B is located at the right end of half-court 5B of playing surface 3. A goal 13B attached to backboard 15B is supported symmetrically over edge 11D of goal shooting area 11B by means of post 17B. A rectangular center court area 10 is located along center line 9. The illustrated boundaries of sections 5A, 5B and goal shooting areas 11A and 11B and center court area 10 are preferably designated by wide lines (i.e., two or three inches wide) marked on playing surface 3.

Referring now to FIG. 2, it can be seen that the backboard and goal assemblies shown in FIG. 1 can be adjusted to different heights. For example, it can be seen that goal 13A has a metal ring 19 which lies in a plane parallel to the plane of playing surface 3. Ring 19 has a net 21 suspended therefrom. Net 21 has a closed bottom so that when the game ball is shot through ring 19, it is caught in net 21. The referee then moves the ball, as subsequently explained. Backboard 15A is attached by means of bolts in selected ones of holes 24 in post 17A so that the height of goal 13A can be adjusted to suit the needs of children in different age groups and having different levels of skill in playing the game of the invention. For example, for very young children, the height of ring 19 can be as low as approximately half a foot, and for full grown or highly skilled players, the height can be over five feet. The radius of the shooting areas is preferably approximately six to seven feet, but can also be varied to suit the needs of children of different ages.

The game of the present invention is played by opposing teams each having six players, although the number of players on each team can be varied, of course. The players of each team attempt to push the ball 30 (shown in FIGS. 4–7) into a goal shooting area 11A or 11B assigned to their team. The players from a first one of the teams (the offensive team) try to move ball 30 from center court area 10 by pushing it with the sides of their feet (for example, as shown in FIG. 3) past the players of the second team (the defensive team) toward the first team's goal shooting area. If the offensive players succeed in moving the ball into their team's goal shooting area where the first team's designated shooter is stationed, he then attempts to score a field goal by "shooting" the ball through the goal 13A, as subsequently explained.

In order to understand the method of playing the game, it will be helpful to assume that player 28, whose lower body is shown in FIGS. 3–7, is an offensive player playing for the first team, and that goal 13A and goal shooting area 11A in FIG. 1 are assigned to the first team. It will be also be helpful to refer to FIGS. 3–7 to describe the techniques for pushing ball 30 and shooting it before describing the method of playing the game in further detail.

Referring now to FIG. 3, player 28 moves his right foot 37 in the direction indicated by arrow 39, using the inner side of foot 37 to push ball 30 in the direction indicated by arrow 33. This manner of pushing ball 30 may be accomplished by either left foot 35 of right foot 37 of player 28. Alternatively, player 28 can push ball 30 with the outer side of either foot. However, no other method of moving or touching ball 30 is permitted, except during shooting.

There are two techniques which are designated shooter can use to propell ball 30 to accomplish shooting ball 30 once the offensive players from his team succeed in pushing ball 30 into his goal shooting area. The first technique is illustrated in FIGS. 4 and 5, wherein it is assumed that player 28 is the designated shooter in goal shooting area 11A. He first positions ball 30 so as to grasp it between the forward inner sides of left foot 35 and right foot 37, as shown in FIG. 4. Player 28 then lowers his body, flexing his knees, as illustrated in FIG. 4, jumps, as shown in FIG. 5, quickly lifts left foot 35 and right foot 37, as indicated by arrow 41 in FIG. 5, thereby propelling ball 30 upward in the direction indicated by arrow 31, aiming ball 30 so as to cause it to go directly through goal 13A either directly or by being deflected off of backboard 15A so that it falls through ring 19 and into net 21. If player 28 succeeds in causing ball 30 to fall through ring 19 into net 21, he scores a field goal. The referee then moves the ball to center court area 10.

The second method of shooting the ball is accomplished with one foot, as indicated in FIGS. 6 and 7. To accomplish the second method of shooting, player 28 first puts toe 37A of his foot 37 on top of ball 30, as shown in FIG. 6, when ball 30 is positioned in front of player 28. Player 28 then uses foot 37 to roll ball 30 backward, as indicated by arrow 44, and then quickly moves toe 37A away from ball 30 and places it on the playing surface in the path of rolling ball 30, so that the momentum of ball 30 causes it to roll up on the top of toe 37A of foot 37, as shown in FIG. 7. Player 28 then quickly lifts right foot 37, propelling ball 30 upward (toward goal 13A), as indicated by arrow 42 in FIG. 7.

Defensive players can attempt to "steal" ball 30 from offensive players by attempting to push ball 30 away from an offensive player having control of ball 30, but only by using the above described technique of moving the ball, as explained with reference to FIG. 3. If a defensive player succeeds in thus "stealing" ball 30 from an offensive player before that offensive player succeeds in moving ball 30 into the goal shooting area 11A of his team, the offensive and defensive roles of the players on each team are reversed, and the second one of the teams becomes the offensive team.

The players from that team attempt to move ball 30 to their designated offensive player, who awaits in the goal shooting area 11B of the second team and attempt to shoot ball 30 through goal 13B in one of the previously described ways.

According to the recommended manner of playing the game of the invention, two players, one from each team, are positioned at locations of their choosing immediately outside of the boundary of the corresponding goal shooting area during the time the designated offensive player attempts to make his field goals. The remaining players move to the center court. The designated player has ten seconds to shoot the ball unimpeded by any of the defensive players, and he scores a field goad if he succeeds in shooting the ball through his team's goal. He is then given ten seconds to attempt to similarly score a second field goal. If the second field goal is missed, the two above-mentioned players standing adjacent the field goal shooting area each attempt to get control of ball 30. Possession of the ball is awarded to the team of the player who succeeds, and he and his teammates attempt to move ball 30 the length of playing surface 3 to their goal shooting area. If the designated offensive player scores a field goal on his second attempt, the referee moves ball 30 to center court area 10, and the players of the other team attempt to move ball 30 from center court area 10 to their goal shooting area.

A predetermined number of "free shots" are awarded to the opposite team if a player of either team commits a foul; the present designated offensive players of each team shoots free shots awarded to his team. Fouls include intentionally touching the ball with any part of the body other than the inner side of a player's foot, kicking the ball, and pushing or kicking another player. After free shots are taken, the referee returns ball 30 to center court area 10, where the other team takes possession of ball 30. Possession is awarded to the other team if a player of one team causes the ball to go beyond the boundaries of the playing area 3.

Each player of a team becomes the designated shooter of that team for a predetermined period of time. The recommended time is ten minutes. During the time that a player is the designated offensive player for his team, he remains within his team's goal shooting area. Any time that the players of his team succeed in moving the ball into his goal shooting area, the designated shooter has the responsibility of attempting to shoot the ball into his goal. The six players on each team each have their turn at being the designated offensive player for a ten minute period, or for the selected period. Thus, the less skillful, smaller, slower, and less aggressive players have an equal opportunity to develop their skills and perform the scoring for this team. It can be seen that the basic rules of the game of the invention reduce the chances of high speed collisions between players and give all players a chance to contribute both offensively and defensively to the success of their respective teams.

While the game of the present invention has been described with respect to one playing court and one method of playing the game, variations from the described playing court and method readily can be made by those skilled in the ball game art without departing from the true scope and spirit of the invention. For example, the various dimensions of the playing court and goal shooting area can be selected to be of any suitable value. The number of goal shooting attempts, free shots, and times a player is a designated shooter can be selected as desired for available playing time and space for the game. The suggested rules can be modified in various ways which do not depart from the scope of the invention, as long as the basic rules for moving and shooting the ball are adhered to.

I claim:

1. A method of playing ball game on a playing surface using an inflated ball, said method comprising the steps of:

a. pushing the ball on the playing surface with a foot of an offensive player past a defensive player into a first goal shooting area, the playing surface having a flat playing surface bounded by a boundary line, the first goal shooting area being located within the boundary line, a first goal including a backboard and a rigid loop facing the court and positioned above a boundary of the first goal shooting area, the rigid loop including a generally circular opening lying in a plane parallel to the playing surface and located a predetermined distance above the playing surface, said pushing being performed only by means of the sides of the feet of the players of the ball game; and b. shooting the ball toward the basket by lifting the ball by means of at least one foot of the offensive player, thereby attempting to score a field goal by causing the ball to travel above the goal and fall through the opening thereof, said shooting being performed by an offensive player within said first goal shooting area while the other players are located outside of said first goal shooting area, said predetermined distance being selected in accordance with the skills of children playing said game, wherein players are assigned to first and second teams, each team having a designated shooter who performs said shooting for his or her respective team, the players of each team being assigned to be the designated shooter for their respective team for a predetermined interval of time, a penalty being imposed on the team of any player who kicks the ball, intentionally touches the ball with any part of his body other than the sides of his feet during said pushing, or intentionally touches the ball with any part of his body other than the sides of his feet or the toes of his feet during said shooting, said penalty including allowing a player from the opposite team to shoot the ball from within said first shooting area.

2. The method of claim 1 wherein the playing surface includes a second goal shooting area and a second goal, said first goal being assigned to said first team, so that only said first team shoots the ball toward said first goal, said second goal being assigned to said second team so that only said second team shoots the ball toward said second goal.

3. The method of claim 1 wherein said predetermined distance is at least approximately six inches.

4. The method of claim 1 wherein said predetermined distance is less than approximately sixty-five inches.

5. The method of claim 1 wherein said playing surface is approximately rectangular.

6. The method of claim 5 wherein said goal shooting area is approximately semicircular and has a radius of approximately six feet.

* * * * *